United States Patent [19]

Saloom

[11] 4,132,012

[45] Jan. 2, 1979

[54] DRYING TOWER FOR THE INNER DIAMETER OF ELONGATED TUBES

[75] Inventor: Joseph T. Saloom, Youngstown, Ohio

[73] Assignee: Wheatland Tube Company, Philadelphia, Pa.

[21] Appl. No.: 782,761

[22] Filed: Mar. 30, 1977

[51] Int. Cl.[2] ..... F26B 25/00

[52] U.S. Cl. ..... 34/105; 34/190; 34/222; 34/236; 198/817

[58] Field of Search ..... 34/21, 33, 104, 105, 34/107, 189, 190, 222, 225, 233, 236; 198/626, 627, 570, 817

[56] References Cited

U.S. PATENT DOCUMENTS

| | | | |
|---|---|---|---|
| 1,697,454 | 1/1929 | Brown et al. | 34/105 |
| 1,980,360 | 11/1934 | Smith | 34/236 |
| 2,612,706 | 10/1952 | Simpson et al. | 34/105 |
| 2,618,075 | 11/1952 | Everhart | 34/105 |
| 2,843,958 | 7/1958 | Hughes, Jr. | 34/105 |
| 3,857,475 | 12/1974 | Smith | 198/627 |

FOREIGN PATENT DOCUMENTS

| | | | |
|---|---|---|---|
| 737,831 | 10/1955 | United Kingdom | 34/105 |

*Primary Examiner*—Kenneth W. Sprague
*Assistant Examiner*—James C. Yeung
*Attorney, Agent, or Firm*—Maky, Renner, Otto & Boisselle

[57] ABSTRACT

A tower for drying the inner diameter of elongated tubes includes a plurality of endless synchronously driven pintle conveyors having vertically ascending and descending support paths for the tubes and an air manifold system operative to force heated air at controlled velocity through the pipes in one direction during ascent and to force heated air at increased controlled velocity through the pipes in the opposite direction during descent. The endless conveyors are supported by a plurality of spaced tower frames, with the two end tower frames having air ducts of the manifold system connected thereto, one of said end tower frames and the air duct carried thereby being movable relative to the other tower frames to permit tubes of varying lengths to be conveyed and dried.

11 Claims, 7 Drawing Figures

DRYING TOWER FOR THE INNER DIAMETER OF ELONGATED TUBES

BACKGROUND TO AND SUMMARY OF THE INVENTION

The present invention relates as indicated to a drying tower for elongated tubes in general and to an air manifold system associated with said tower for sequentially forcing heated air at controlled velocities through the elongated tubes in opposite directions to dry the coated interior diameter of such tubes in particular.

Continuous tube forming and galvanizing process lines are well known in the art as shown, for example, by U.S. Pat. Nos. 3,122,114 and 3,845,540. Such process lines operate at speeds from 50 to 400 feet per minute rapidly to produce the galvanized tube or pipe product. Such galvanized tube may be interiorly and exteriorly coated either on the line as shown in U.S. Pat. Nos. 3,559,280; 3,616,983 and 3,768,145 or off the line after cut-off.

When the inner diameter of the galvanized tube has been painted, the cut lengths of such tube must be properly interiorly dried to provide a uniform paint surface. One method of heating interiorly painted tubes has been proposed and pursued for drying the inner diameter of such tube.

Specifically, the interiorly painted tubes may be conveyed through a large gas fired furnace. However, the use of such gas fired furnace has several drawbacks. Specifically, the size of the costly furnace requires significant floor area in the plant, and the operation of such furnace is rather expensive. Moreover, the whole tube is being heated in such a furnace, requiring the tubes to be in the furnace for extended periods of time and to be conveyed at relatively slow feed rates in order to bring the tube to the necessary temperature to attain the interior effect necessary. Therefore, the feed rate through the furnace is considerable slower than the operating speeds of a continuous galvanizing process line resulting in decreased efficiency in using such line and in reduced production.

It is accordingly the principle object of the present invention to provide a drying tower for interiorly coated tube. By providing a tower apparatus having a conveyor with vertical ascent and descent paths for the interiorly painted tubes, the drying can be effected by apparatus occupying minimal floor space and operating at relatively high speeds generally compatible with a continuous galvanizing line.

It is yet another object of the present invention to force heated air at controlled velocities through the interiorly painted tubes in one direction during ascent and to force heated air at increased controlled velocities through the tubes in the opposite direction during descent. The use of bi-directional air flow reduces the possibility of an air pocket being formed during drying and thereby improves the uniformity of the drying operation. The use of lower velocity heated air in one direction during ascent permits the paint adequately to set before the higher velocity air for final drying is directed therethrough in the opposite direction on descent.

It is still another object of the present invention to provide a drying tower that may be readily adjusted to handle interiorly painted tubes of varying length. To this end, one of the end tower frames carrying air manifold system ducting is selectively movable relative to the other tower frames so that tubes of varying lengths may be selectively conveyed and dried with the air nozzles for such ducting always being positioned at a predetermined spacing from the ends of the tube aligned therewith.

Other objects and advantages of the present invention will become apparent as the following description proceeds.

To the accomplishment of the foregoing and related ends the invention, then, comprises the features hereinafter fully described and particularly pointed out in the claims, the following description and the annexed drawings setting forth in detail certain illustrative embodiments of the invention, these being indicative, however, of but a few of the various ways in which the principle of the invention may be employed.

DETAILED DESCRIPTION OF THE DRAWINGS

DETAILED DESCRIPTION OF THE PREFERRED EMBODIMENT OF THE INVENTION

Figure 2:
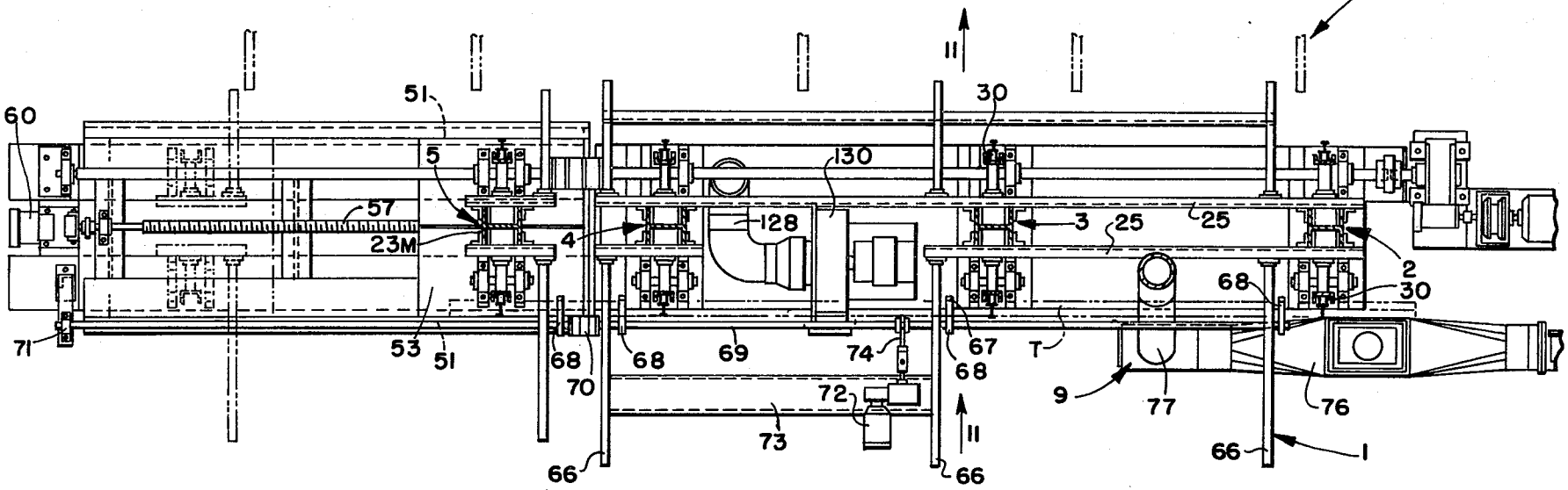
FIG. 2 is a sectional view taken along line 2—2 in FIG. 1 showing the details of the conveyor and movable tower frame drive systems in their relative plan orientation.
Figure 4:
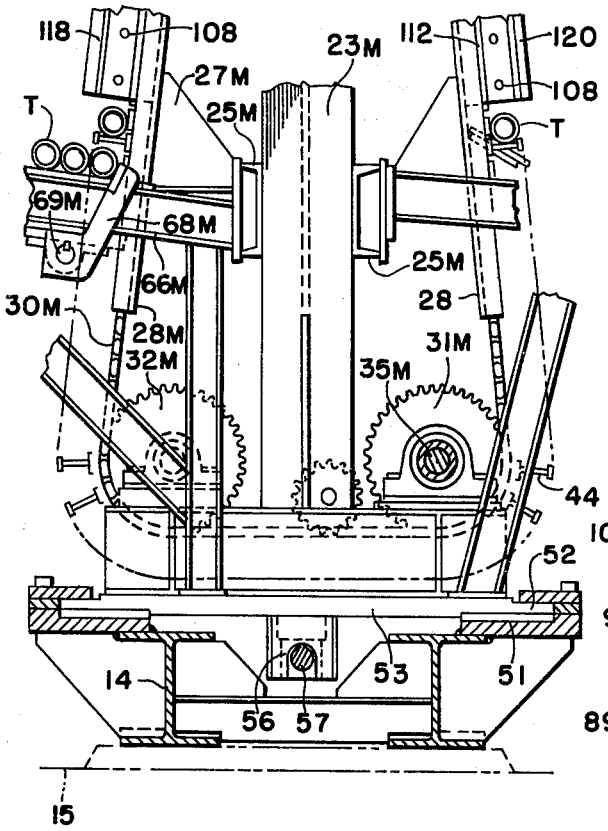
FIG. 4 is a fragmentary vertical section taken along the plane 4—4 in FIG. 1 showing the mounting of and drive for the movable tower frame.

Referring now in more detail to the drawings and initially to FIGS. 2 and 4, a plurality of elongated tubes T having freshly painted inner diameter surfaces are advanced in side to side engagement along a downwardly inclined feed ramp system indicated generally at 1 toward the drying tower consisting of spaced tower frames 2, 3, 4 and 5. As used herein, the term "tubes" means any hollow elongated member of any cross sectional shape, gauge, material or length. The tubes T are then picked up one by one by a pintle chain conveyor system 7 on the tower frames 2–5, such conveyor system being operative to carry and index such tubes along a vertically ascending and then descending drying path.

During such ascent and descent, the paint on the inner diameter of the conveyed tubes is dried by controlled heated air being directed therethrough in oppositely directed flow paths by the air manifold system indicated generally at 9. At the bottom of the descent path, the paint on the inner diameter of the tube is completely and uniformly dry and such tube is fed onto a run-out ramp system 10 leading to a tube bundling station or the like. The above described major components of the drying tower of the present invention and the operation thereof will now be described in more detail.

A. The Tower Frames 2–5 and Pintle Chain Conveying System 7 Carried Thereby

Figure 1:
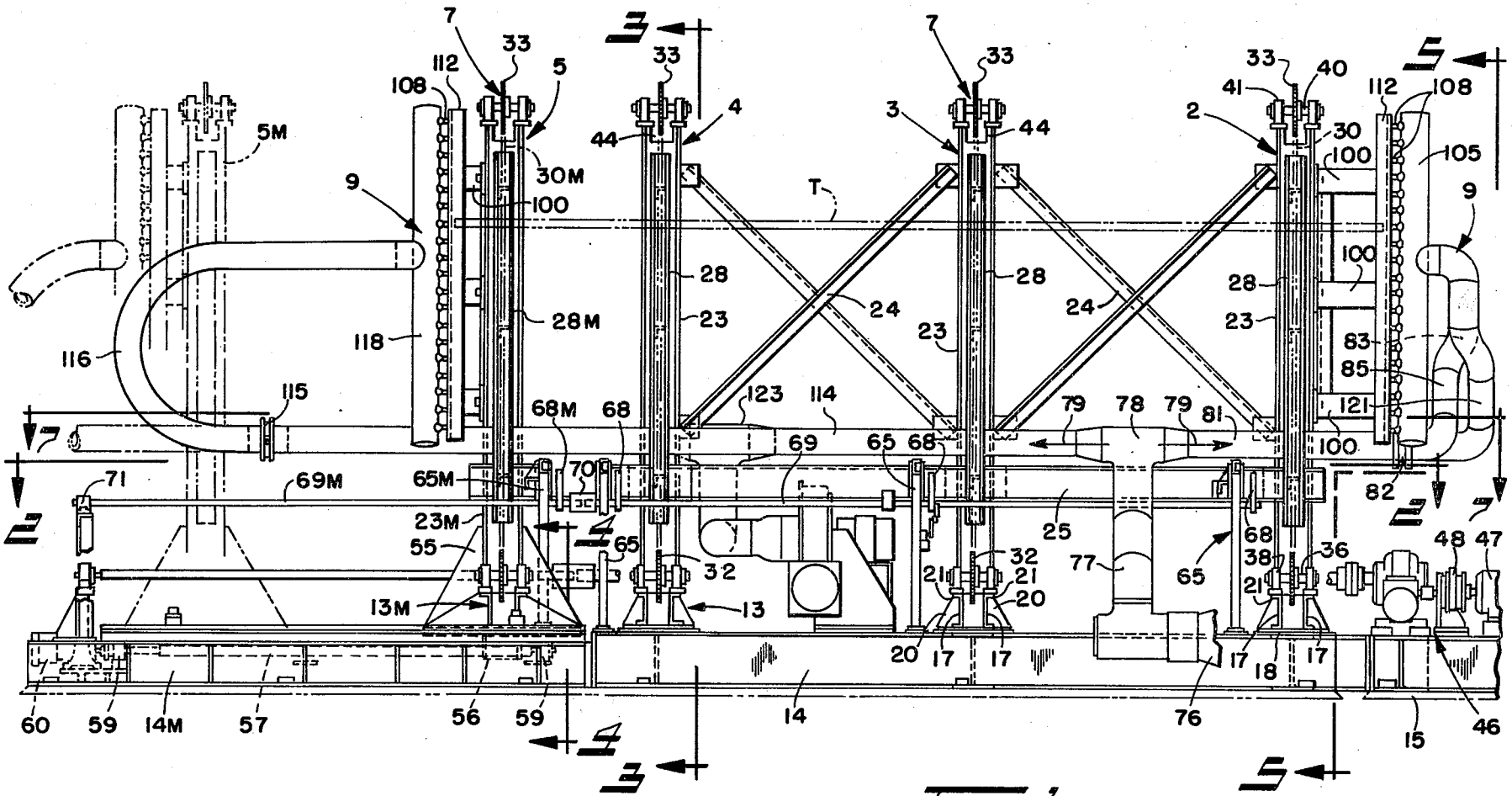
FIG. 1 is a front elevation showing the drying tower of the present invention from the tube feed side of the same with a portion thereof being broken away for clarity of illustration and with the movable tower frame being shown in both full and phantom lines to illustrate the extremes of travel therefor.
Figure 3:
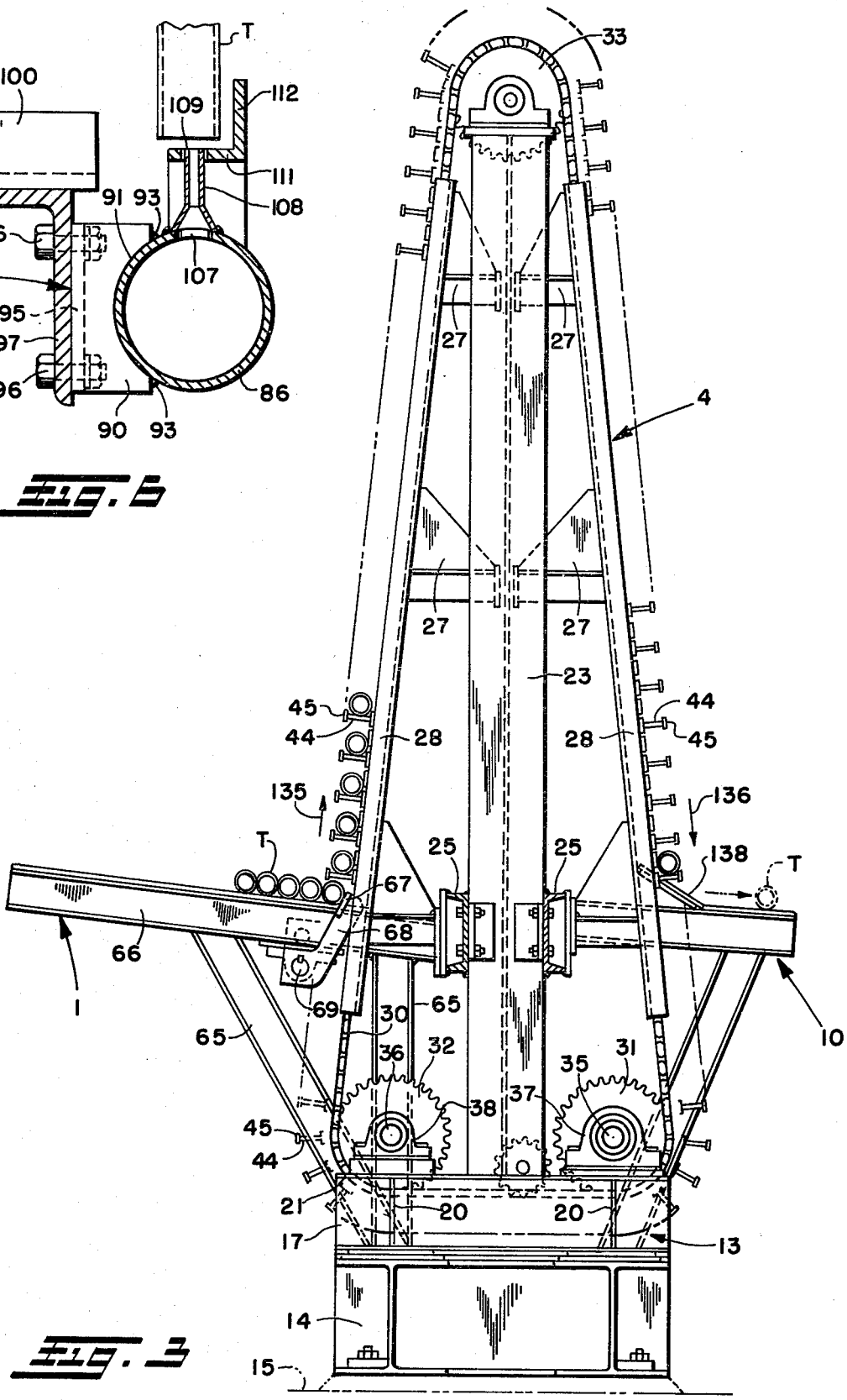
FIG. 3 is a side elevation taken along the plane 3—3 of FIG. 1 showing a fixed tower frame and associated tube feed and removal ramps.

Tower frames 2–4 are in fixed transversely spaced positions, while tower frame 5 is transversely movable relative to the frames 2–4, with the term "transversely" as used herein meaning perpendicular to the direction of tube movement as indicated by arrow II in FIG. 2. Referring to FIGS. 1 and 3, each of such fixed tower frames 2–4 includes a base, indicated generally at 13, fixedly mounted on a transversely extending foundation 14 secured to the floor 15. Such base 13 includes two longitudinally extending, transversely spaced channels 17 secured to a bottom plate 18 mounted on the top surface of the foundation 14. Such channels 17 are rigidfied by transversely extending, longitudinally spaced triangular plates 20 extending between the base plate 18 and the top web 21 of the channels. A vertically upwardly extending I-beam 23 is connected at its bottom to the central portion of the top webs of transversely spaced channels 17 as best shown in FIG. 2. Such I-beams 23 on fixed tower frames 2–4 are interconnected at their tops by cross braces 24 and at their bottoms by two transversely extending and longitudinally spaced channels 25 on opposite sides of I-beams 23 as best shown in FIGS. 2 and 3.

Such I-beams 23 have a plurality of vertically spaced mounting members 27 extending horizontally outwardly from both sides of the interconnecting web thereof to support chain guides 28 at the outer ends thereof. Such chain guides 28, which are channel shape in cross-section, are more widely spaced at the bottom than the top resulting in their convergence generally toward the apex of the I-beam as best shown in FIG. 3.

Each of such chain guides 28 on each of the tower frames receives therein an endless chain 30 describing a generally triangularly shaped path of movement defined by the sprockets employed. Specifically, said chain 30 extends around and is in mesh with a drive sprocket 31, a bottom guide sprocket 32 and a top guide sprocket 33. The drive sprocket 31 and lower guide sprocket 32 are respectively keyed to shafts 35 and 36 rotatably mounted in longitudinally spaced back and front pillow blocks 37 and 38 secured to the top webs 21 of the transversely spaced base channels so that sprockets 31 and 32 vertically extend into the space between such channels 17. The top guide sprocket 33 is keyed to shaft 40 rotatably journaled to pillow blocks 41, which are secured to the top of the I-beam 23, with the vertically oriented top sprocket 33 extending into a notch 43 cut in the interconnecting web of the I-beam. Each of such endless chains 30 has a plurality of correspondingly spaced outwardly extending pintles 44 with separation flanges 45 connected to the ends thereof.

The endless conveyor chains 30 are synchronously driven along their triangular paths by the drive sprockets being commonly mounted on the drive shaft which extends transversely of the fixed tower frames as best shown in FIG. 2. As will be described in more detail hereinafter, such drive shaft 35 is coupled at the left end as viewed in FIGS. 1 and 2 to a drive shaft extension 35M for the transversely movable frame 5. Such drive shaft at the right end is coupled to a drive train 46 mounted to the foundation 14. Such drive train includes motor 47, a clutch brake assembly 48, and a gear speed reducer 49 operative selectively to rotate drive shaft 35 and drive shaft extension 35M. The selective rotation of such drive shaft is operative intermittently and synchronously to drive each of the clains 30 on each of the tower frames in indexing fashion as described in more detail hereinafter.

Turning now to the transversely movable tower frame 5, the construction thereof includes many structural elements that are the same as corresponding elements on the fixed frames 2–4, with like parts being identified by like numerals with the suffix M. The foundation for the movable tower frame includes two longitudinally spaced transversely extending ways 51 that are channel shaped and face inwardly toward one another as best shown in FIG. 4. Such ways 51 slidingly receive the lateral edges 52 of a carriage 53 to which the base 13M of the transversely movable tower frame 5 is connected. As best shown in FIG. 1, such carriage includes upwardly extending, triangularly shaped plate members 55 to rigidify the I-beam 23M. An internally threaded elongated nut 56 is connected to and depends downwardly from such carriage 53, with the threads of such nut 56 being in mesh with the threads on transversely extending drive screw 57. Such drive screw is rotatably mounted in transversely spaced pillow blocks 59 at opposite ends of the foundation 14M, with the left end of such drive shaft as viewed in FIG. 1 being coupled to reversable motor 60. Actuation of such motor in one direction will result in rotation drive screw 57 axially to drive the nut 56, carriage 53 and tower 5 to the right as viewed in FIG. 1. By reversing the motor, the drive screw can be rotated in the opposite angular direction resulting in the nut 56, carriage 53 and tower frame 5 being driven to the left in FIG. 1. As shown by the phantom lines 5M and solid lines 5, the tower frame can be moved in either direction approximately 6 feet readily to accommodate tubes varying in overall length from 18 to 24 feet.

Such variation in tower position requires that the drive sprocket 31M on such tower be slidable along the drive shaft for the same. To this end as best shown in FIGS. 1 and 2, a drive shaft extension 35M is rotatably driven by the drive shaft 35 through coupling member 62. Such drive shaft extension 35M includes a keyway along the surface thereof to receive a key on the drive sprocket 31M. Such keyway permits the key on the sprocket and thus the sprocket itself to slide axially therealong during movement of tower frame 5, but provides a rotary drive connection when the drive shaft and drive shaft extension are rotated. Therefore, the drive shaft 35 and drive shaft extension 35M are intermittently rotated by the drive train simultaneously and synchronously to drive each of the endless chain pintle conveyors 30 on the tower frames, thereby uniformly to advance tubes delivered thereto by the feed ramp system 1.

B. The Tube Feed System 1

The tube feed system includes a plurality of transversely spaced tube feed stands 65 connected to and extending upwardly from the foundation to support downwardly inclined, longitudinally extending feed ramps 66 respectively secured at their leading ends to transversely extending channel 25. As best shown in FIG. 1, such stands 65 are located at positions closely adjacent to but slightly transversely offset from tower frames 2–5. The transversely extending tubes T, which have freshly painted interior surfaces, are supported by and advanced in side to side relationship downwardly along the inclined ramps 66 until the lead tube thereof is engaged at transversely spaced locations by stop faces 67 on the distal ends of angularly adjustable levers 68.

As shown in FIGS. 1, 2 and 4, such levers 68 are keyed to a common actuating shaft 69 extending transversely of the tower frames. Such shaft 69 is coupled at 70 to a lever shaft extension 69M having an axially slidable lever 67M mounted thereon by a key and keyway connection. Such lever 67M slides transversely with the movable tower frame 5 and with the support stand 65M connected thereto to position the same adjacent the left end of the delivered tube irrespective of the location of the movable tower frame 5. The lever shaft 69 and extension 69M are journalled in pillow blocks 71 selectively to permit slight rotation thereof as desired. Such selective rotation is effected by a motor and gear box assembly 72 mounted on a table 73 (FIG. 2) supported between two of the feed ramps 66, with the actuating shaft 74 thereof being eccentrically connected to shaft 69. Such motor and gear assembly 72 is selectively actuated to rotate the shaft 69 and levers 68 keyed thereto to an angular position in which the stop faces 67 on levers 68 are located to insure that only one tube at a time is picked up by the conveyor system. Such angular location is selected according to the diameter of the tube being handled so that the leading edge of the tube is engaged by stop faces 67 while the trailing edge of the tube is in vertical alignment with the separator flanges 45 on the pintles 44 of chains 30. Thus, the intermittent clockwise rotation of the four chains 30 as viewed in FIG. 3, results in the ascending, matched pintles 44 thereon simultaneously engaging and then picking up the lead tube on ramps 66, with the separator flanges passing directly between the lead and second tubes to insure that only one tube is picked up at a time for interior drying by the air manifold system.

C. Air Manifold System 9

Figure 7:
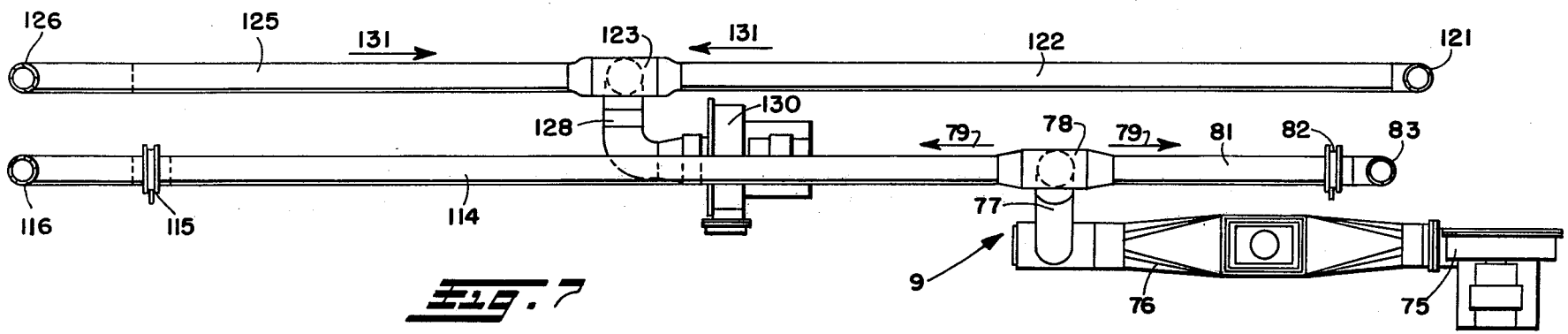
FIG. 7 is a horizontal cross-section taken along the plane 7—7 in FIG. 1 showing the details and arrangement of the blowers, heaters and control valves for the air manifold system with the tower frames removed for clarity of illustration.
Figure 5:
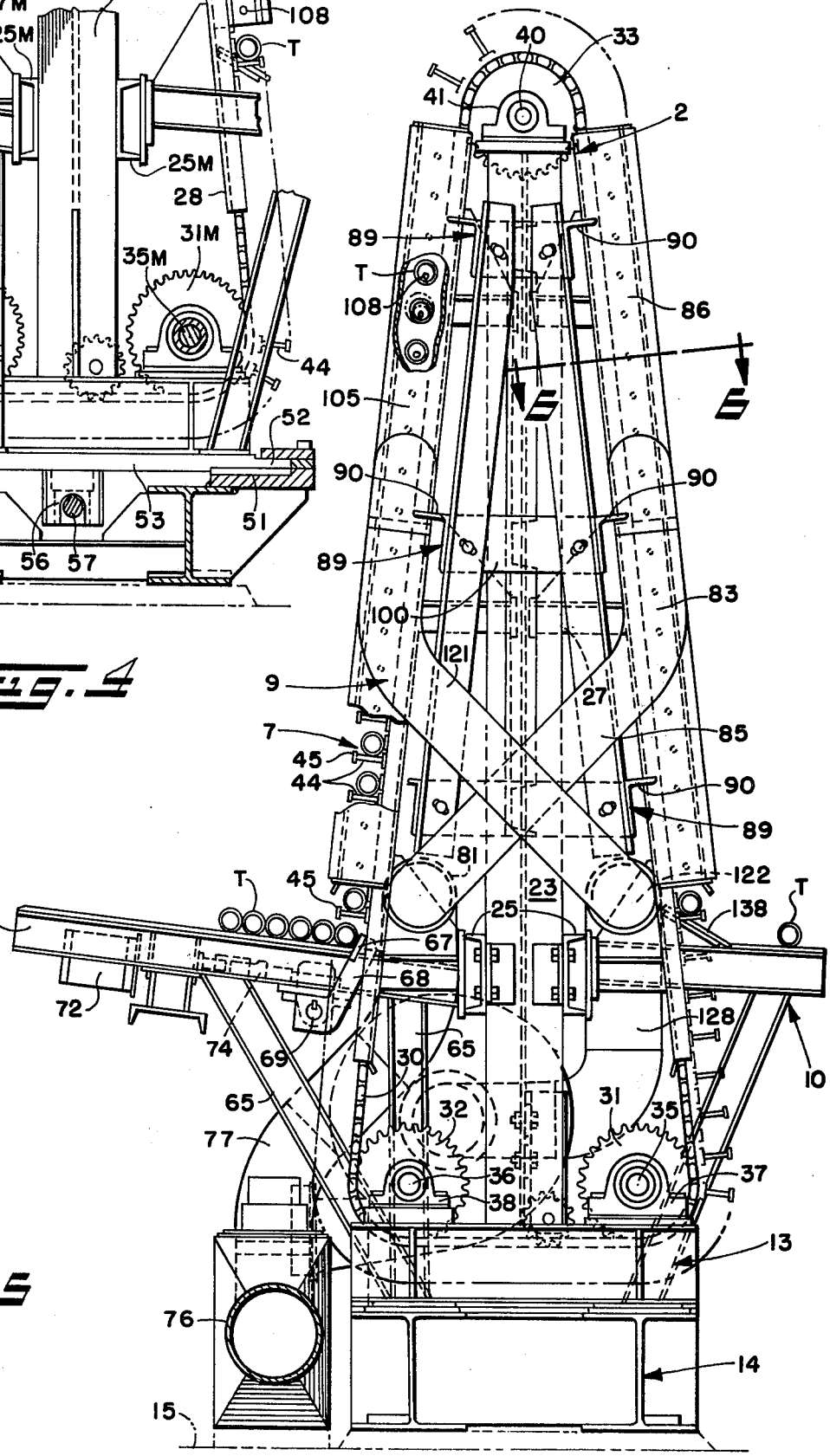
FIG. 5 is a side elevation taken along the plane 5—5 in FIG. 1 showing the fixed end tower frame and the cross-over ducting of the air manifold system carried thereby, with portions thereof being broken away to show details of the tube feed system and the endless pintle conveyor chains cooperating therewith.

The air manifold system includes a delivery blower 75 (FIG. 7) to force air through a heater 76 operative to elevate the temperature of the air to a preselected value. Such heated air is then delivered into a riser duct 77 leading to a Tee 78 to bifurcate the air flow as indicated by the arrows 79 in FIG. 1. The heated air moving to the right as viewed in FIG. 1 passes along a right horizontal delivery duct 81, through a control valve 82 and then into a vertically extending cross-over duct 83. As best shown in FIG. 5, such cross-over duct includes a rearwardly extending portion 85 leading to an inclined delivery header 86 that lies in a common plane with the descending tubes carried by the conveyor system 7 at the right end of such tubes as viewed in FIG. 1.

Figure 6:
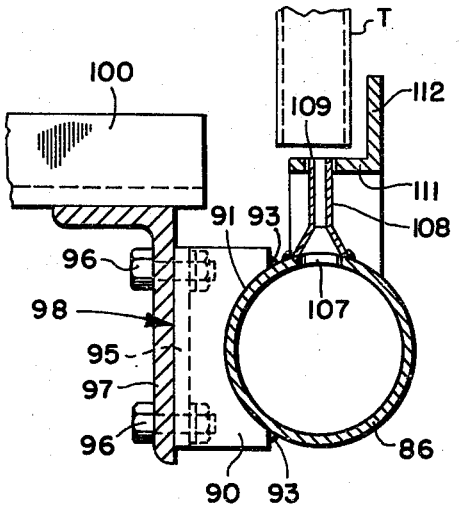
FIG. 6 is a horizontal section taken along the plane 6—6 in FIG. 5 showing the details of a header duct and the air nozzle passages therefrom to direct air movement through the tube aligned therewith.

As best shown in FIGS. 5 and 6, such header 86 is supported in such position by a plurality of vertically spaced brackets 89 having horizontal webs 90 with semicircular cut-outs 91 therein respectively to receive and mount the header 86 therein by welds 93. The vertically inclined leg 95 of each bracket 89 has two spaced slots therein selectively to receive fasteners 96 passing through one web 97 of a vertically extending, inclined angle support 98, which generally parallels the descending conveyor path. At spaced vertical intervals, three horizontally cantilevered mounting arms 100 are connected at one end to the other web 102 of inclined angle support 98 and at the other end to the vertically upstanding I-beam 23 of the tower frame 2. Such arms are of sufficient longitudinal or fore and aft extent similarly to mount oppositely inclined angle support 98 carrying ascent return header 105 lying in the plane of the upwardly ascending tubes on the conveyor.

At spaced locations along the vertical extent of header 86, holes 107 are provided that communicate with vertically spaced air nozzles 108 having delivery ends 109 flush with the inner face of guide flange 111 for vertically extending alignment angle 112 carried by header 86. Such vertically spaced nozzles 108 are generally aligned with the ends of tubes carried on and indexed by the conveyor system during the descent path. Therefore, such nozzles 108 provide direct communication between the descent delivery header 86 and the descending tubes T to permit heated air to be forced therethrough under the influence of delivery blower 75 communicating therewith.

The heated air flowing to the left of Tee 78 as viewed in FIG. 1 under the influence of delivery blower 75 passes along a horizontal left delivery duct 114 through an air control valve 115 and into a U-shape flexible duct 116. The end of flexible duct 116 is connected to a delivery header 118 which is oriented to lie in the same plane as and at the left end of the vertically ascending tubes T on the conveyor system. Such header 118 is mounted in cantilevered fashion on the movable tower frame in the same general manner as descent delivery header 86, with like mounting parts being identified with like numerals. As illustrated by the phantom lines in FIG. 1, the flexible duct 116 permits tower frame 5 to be moved relative to the other tower frames as described above while maintaining desired air flow patterns and the spacing between the air nozzles 108 and the ends of the tubes being dried.

Thus it will be seen from the above description that the air directed into the manifold system by the delivery blower is bifurcated for forcing the air through the tubes in different directions during their ascent and descent. Specifically, the air delivered by blower 75 is forced through the tubes from left to right during their ascent and from right to left during their descent as viewed in FIG. 1.

Such delivery air is being positively pulled through the tubes by the return part of the air manifold system. Such return part of the system includes the return header 105 mounted in the manner described above to the fixed frame 2 in the same plane as the ascending path of the tubes and a return header 120 mounted to the movable tower frame 5 in the same plane as the tube descent. The ascent and descent return headers 105 and 120 have vertically spaced air nozzles 108 that are aligned with the correspondingly spaced nozzles 108 on the ascent and descent delivery headers 118 and 86, respectively, thereby to provide a plurality of delivery and return nozzle pairs respectively aligned with tubes indexed into place therebetween by the conveyor system 7.

Return ascent manifold 105 communicates with a cross-over duct 121 leading to a horizontal light return duct 122 connected to Tee 123. The other side of Tee 123 is connected to a horizontal left return duct 125 coupled to a U-shape flexible duct portion 126 communicating with descent return manifold 120. The bottom leg of the Tee 123 has an exhaust duct 128 connected thereto leading to return blower 130. Such return blower when operating provides a suction effect to draw air from the tubes and through the return lines in the direction of the arrows 131 of FIG. 7. Such flow through return header 105, cross-over 121 and right return duct 122 operates positively to draw the air out of the right end of the tubes as viewed in FIG. 1 during their ascent, whereby the heated air moving through such tubes is forced in from the left and drawn out from the right. Similarly, the air flow from return header 120 through U-shape flexible duct 126 and left horizontal return duct 125 into Tee 123 is positively drawing the air out of the left ends of the tubes during their descent on the conveyor. Therefore, the air forced into the tubes at the right side of FIG. 1 during their descent by the heated air delivery system is positively withdrawn from the left side by the return or suction system.

D. Operating of the System

Before operation of the drying tower is commenced, several preliminary steps are taken to condition the interrelated systems of the tower to the tubes to be interiorly dried. In the feed system 1, the levers 68 are angularly adjusted by motor and gear box assembly 72 according to the outer diameter of the tube properly to position the stop faces 67 thereon to engage the lead edge of the tube when the trailing edge is in alignment with separator flange 45. In the tower frame system, the movable frame 5 is transversely adjusted relative to the other frames 2–4 as required by the length of the tube to be handled, thereby to provide well spaced support therefor by the conveyor system and to position the outlets of air nozzles 108 on the movable headers 118 and 120 close to the left ends of the tubes.

In the air manifold system, the heater 76 is set to heat the delivered air to a temperature compatible with the paint being dried. Moreover, the control valves 82 and 115 are also set to control the velocity of the air being delivered to the tubes to a level compatible with the paint being dried and with the set time therefor, with the valves 82 and 115 normally being set to deliver air to ascent header 118 at lower velocities than the air being delivered to descent header 86. On rare occasions, the headers 86, 105, 118 and 120 may have to be equally vertically adjusted by changing the position of fasteners 96 in the slots therefor vertically to shift the angle supports 98 and headers relative to the arms 100 to provide alignment between the paired nozzles 108 and the inner diameter of the tube being dried. However, this adjustment is normally not necessary since the paired nozzles 108 are positioned below the centerline of most tubes indexed therepast. Thus, as shown in the broken away portion of return header 105 in FIG. 5, the nozzles 108 are near the bottom of the tubes dwelling therebetween permitting air positively to be controlled for the tubes shown in full lines or for smaller or larger diameter tubes indicated by the phantom lines.

When the systems have thus been adjusted, the conveyor drive train, delivery and return blowers and heater are actuated to begin the operation of the drying tower. Thus, as the chains 30 are synchronously advanced by the drive train in a clockwise direction as viewed in FIG. 3, the ascending matched pintles 44 will pick up the leading tube on ramps 66, with the separator flange dividing such tube from the remaining tubes. Once the chains and aligned pintles thereon are indexed to the next position by the drive train, the then leading tube rolls downwardy into engagement with the spaced stop faces 67 on lever 68 to await pick-up.

The tubes as thus individually picked up are carried by the synchronously driven pintle chains 30 along an ascending path 135 forming a first drying stage and a descending path 136 forming a second drying stage. Such tubes are intermittently indexed along such paths by the drive train, with the extent of movement for each indexed advancement equalling the distance between the paired nozzle openings 108. Therefore, the tubes are sequentially brought into alignment with each pair of nozzles 108 on the respective ascent and descent manifolds, with the drive train being controlled to permit a dwell period of from two to three seconds at each location or drying stage.

As the tubes are indexed upwardly into successive alignment with the correspondingly spaced nozzle orifices 108 on the ascent headers, heated air is forced by the delivery blower 75 through delivery header 118 and into the left ends of the tubes aligned therewith. Simultaneously, the air is being drawn out of the right end of such tubes by return ascent manifold 105 under the influence of return blower 130. The paint on the inner diameter of the tubes begins its drying and setting procedure on ascent which permits air of increasing velocity to be oppositely directed therethrough during descent. Such air flow on descent is accomplished by delivery blower 75 forcing air through descent delivery manifold 86 and into the right end of the tubes aligned therewith as viewed in FIG. 1. Such air then moves through the tubes from right to left during descent and is positively drawn outwardly therefrom by return blower 130 setting up a suction effect in return descent manifold 120. When the tubes reach the bottom of the descent path, the interior thereof is completely and uniformly dry, and the thus dried tube is removed from the pintles 44 on chains 30 by stripper bars 138 cooperating with the downwardly inclined run-out ramp 10.

I, therefore, particularly point out and distinctly claim as my invention:

1. An apparatus for drying the inside diameter of elongated hollow tubes comprising conveyor means operative to advance tubes carried thereby through at least two drying stages including a plurality of drying stations, and drying means operative to move air through said tubes in one direction at each station of said first stage and subsequently operative to move air through said tubes in an opposite direction at each station of said second stage, said drying means including a first pair of air delivery and return headers for the first drying stage and a second pair of air delivery and return headers for the second drying stage, the air delivery and return headers of each pair having correspondingly spaced orifices along the lengths thereof to define the drying stations formed by the aligned orifice pairs, with such orifice pairs being respectively aligned with at least one of the advancing tubes sequentially positioned therebetween for air movement therethrough.

2. The apparatus set forth in claim 1 wherein the conveyor means has indexing means operative sequentially to advance the tubes carried thereby into alignment with said orifice pairs and to dwell briefly in such position while air is passed therethrough.

3. The apparatus set forth in claim 2 further comprising first blower means to force air through the delivery headers and orifices therein into the tubes aligned therewith and second blower means to provide suction positively to draw air from the tubes through the orifices aligned therewith and the return headers.

4. The apparatus set forth in claim 3 wherein the first blower means is common to the air delivery headers of both pairs and the second blower means is common to the air return headers of both pairs.

5. The apparatus set forth in claim 4 further including air control means to produce lower air velocities through the tubes during the first drying stage than the air velocities generated through the tubes during the second drying stage.

6. The apparatus set forth in claim 1 wherein the conveyor means consists of a plurality of endless pintle chains and a plurality of laterally spaced tower frames respectively to carry said chains.

7. The apparatus set forth in claim 6 wherein the delivery and return headers are carried by end tower frames.

8. The apparatus defined in claim 7 further comprising means selectively reciprocally to move one of the end tower frames relative to the other tower frames to permit tubes of different lengths to be conveyed.

9. The apparatus defined in claim 7 wherein the tower frames are triangular in shape to provide a first upwardly ascending conveyor path to the apex of the tower frames to define the first drying stage and a second descending conveyor path from said apex to define the second drying stage.

10. The apparatus defined in claim 6 wherein adjustable stop means are positioned adjacent the towers to locate the tubes relative to the endless pintle chains carried thereby to insure that only one tube is picked up at a time by said chains.

11. The apparatus defined in claim 10 wherein the stop means include levers mounted on a common rotatable shaft, the angular position of such shaft being selected to locate the levers to engage the lead edge of the tube being fed to the conveyor means when the back edge thereof is in alignment with separator flanges on the pintles.

* * * * *